US008678192B1

(12) United States Patent
Pung et al.

(10) Patent No.: US 8,678,192 B1
(45) Date of Patent: Mar. 25, 2014

(54) GOLD CUBE

(76) Inventors: Michael Pung, Midwest City, OK (US); Stevan Wilcox, Arvada, CO (US)

( * ) Notice: Subject to any disclaimer, the term of this patent is extended or adjusted under 35 U.S.C. 154(b) by 336 days.

(21) Appl. No.: 13/200,953

(22) Filed: Oct. 5, 2011

Related U.S. Application Data

(60) Provisional application No. 61/455,806, filed on Oct. 27, 2010.

(51) Int. Cl.
*B03B 5/00* (2006.01)

(52) U.S. Cl.
USPC ..... 209/44; 209/18; 209/458; 209/500; 209/506

(58) Field of Classification Search
USPC ..... 209/18, 44, 44.2, 458, 477, 500, 506, 209/906
See application file for complete search history.

(56) References Cited

U.S. PATENT DOCUMENTS

| | | | | | |
|---|---|---|---|---|---|
| 525,983 | A | | 9/1894 | Irvin | |
| 540,144 | A | * | 5/1895 | Canfield | 209/13 |
| 620,014 | A | * | 2/1899 | Blacket | 209/44 |
| 801,968 | A | | 10/1905 | Clark | |
| 849,614 | A | | 4/1907 | Holmes | |
| 937,033 | A | * | 10/1909 | Luckenbach | 209/181 |
| 1,123,188 | A | * | 12/1914 | Green | 209/14 |
| 1,973,770 | A | * | 9/1934 | McCullough | 209/14 |
| 2,174,925 | A | | 10/1939 | McKeever | |
| 3,941,690 | A | | 3/1976 | Powers | |
| 3,970,551 | A | | 7/1976 | Wright | |
| 4,199,441 | A | | 4/1980 | Ross | |
| 4,253,943 | A | | 3/1981 | Thrasher | |
| 4,290,527 | A | | 9/1981 | Wright | |
| 4,319,985 | A | | 3/1982 | Hibbard | |
| 4,322,288 | A | * | 3/1982 | Schmidt | 209/356 |
| 4,525,270 | A | | 6/1985 | McCann | |
| 4,565,624 | A | * | 1/1986 | Martinez | 209/40 |
| 5,421,461 | A | * | 6/1995 | Ruzic | 209/44 |
| 5,617,955 | A | * | 4/1997 | Tanner | 209/458 |
| 5,785,182 | A | | 7/1998 | Ashcraft | |
| 5,927,508 | A | | 7/1999 | Plath | |
| 6,216,367 | B1 | * | 4/2001 | Tubbs | 37/314 |
| 6,799,681 | B1 | | 10/2004 | Warren | |
| 7,012,209 | B2 | | 3/2006 | Loewen | |
| 7,438,188 | B2 | | 10/2008 | Stolworthy | |
| 7,811,088 | B2 | * | 10/2010 | Plath | 433/92 |
| D658,407 | S | * | 5/2012 | Pung et al. | D6/479 |
| 2009/0078615 | A1 | * | 3/2009 | Rainwater et al. | 209/44 |
| 2010/0193406 | A1 | | 8/2010 | Alderson | |

* cited by examiner

*Primary Examiner* — Joseph C Rodriguez
(74) *Attorney, Agent, or Firm* — Randal D. Homburg

(57) ABSTRACT

A mineral separating gold cube concentrator presents at least two modular portable stacking trays defining alternating inclined surfaces over which a continuing supply of water flows. A first tray provides an inclined smooth surface with controlled water flow to the incline which imparts fluidity allowing the aggregate to move downward and form a slurry that separates the aggregates into lightest first, heaviest last. A second tray is a collection tray is below the first tray and defines a G force separator, forcing all materials under the gate into vertical column within the turbulent water, the column descending upon the vortex mat upon the second tray, forcing the lighter materials within the aggregate to advance ahead of the heavier material. Any material not captured by the vortex mat travels to the end of the matting and is either expelled or subsequently transferred into another collection tray through another G force separator.

20 Claims, 5 Drawing Sheets

GOLD CUBE

CROSS REFERENCE TO RELATED APPLICATIONS

Applicant claims the benefit of Provisional Patent Application Ser. No. 61/455,806, filed on Oct. 27, 2010, by the same named inventors herein.

I. BACKGROUND OF INVENTION

1. Field of the Invention

A portable mineral separation apparatus of at least two modular stacking trays set at alternating inclines surfaces, provides the stacked trays in two types. A first and uppermost tray is provided with a flood box to introduce a controlled flow of water at a top incline with a sufficient flow to compel particles of aggregate to move down a smooth incline and form a slurry that separates the aggregate according to the relative specific gravity of the particles from lightest to heaviest. The aggregate slurry is contained within vertically projecting side walls to direct the slurry down the incline and contain the entire slurry. A second tray is a collection tray, progressing the slurry from the first tray, further processing the slurry which falls and passes through a gated axial trough, which is part of the apparatus known as a G force separator, forcing the materials under a gate, converting the slurry into a column within the water flow that attempts level equalization allowing lighter materials to advance ahead of the heavier materials, including gold. The slurry is force down a similar incline, but this incline contains a collection and concentrator mat, known as a vortex mat, introduced to collect and concentrate the heavy materials, including black sand and gold, defining the process and function of the second tray. Any material not captured within the vortex mat travel down the incline into another collection tray, wherein the process of the second tray is repeated. The process waste aggregate is washed from the bottom of the last tray, while the trapped heavier particles, including the gold, are captured within the vortex mat and intentionally released into a pan when the vortex mat is rinsed with water.

2. Description of Prior Art

A preliminary review of prior art patents was conducted by the applicant which reveal prior art patents in the field of gold separation using a hydraulic water flow within a sluice or other structural device. They primarily are found within Class 209, as devices for the classification, separation and assortment of solid materials, such as mineral rich aggregates. However, the prior art inventions do not disclose the same or similar elements as the present portable heavy material concentrator and gold particle separator, nor do they present the material components in a manner contemplated or anticipated in the prior art. Primarily, none of the prior art devices provide a plurality of angled trays which include a device which is the same as or the substantive equivalent of the G force concentrator which forms a gated axial trough assembly involving each axial trough at the first end and the vertical gate from second end of the immediate above tray provided to force the flow of water around the vertical gate in a smooth rounded flow, causing the water and aggregate slurry to elevate above the next lower tray, causing the lighter aggregate particles to rise higher in the accelerated water flow while the heavier particles of the aggregate slurry are lower in the accelerated water flow, causing a specific gravity separation of the particulate in the water flow and along the surface of the mat on the lower inclined tray, this occurring on at least two occasions in a three tray stack, three occasions on a four tray stack, and so forth.

The prior art patents located are generally involving general topical categories, all pertaining to gold particle separation from an aggregate. A first set uses a mat in the bottom of a slurry tray. These patents include U.S. Patent Application No. 2010/0193406 to Alderson, which uses a ribbed rubber mat, U.S. Pat. No. 7,012,209 to Loewen, which utilizes a gold collection medium which is disclosed as a ribbed mat having ribs and grooves, being made of vinyl or plastic, to induce a positive charge to the mat caused by the flow of water and particulate materials, U.S. Pat. No. 5,927,508 to Plath, which uses a mat of susceptible particulate material, disclosed as a polymeric sheet in which a magnetized material is incorporated, and U.S. Pat. No. 3,941,690 to Powers, using a removable flexible riffle mat. Cocoa mats are placed in the bottom of machines and sluice boxes in U.S. Pat. Nos. 2,174,925 to McKeever and 4,199,441 to Ross. Reverse angled sluices are disclosed in U.S. Pat. Nos. 6,799,681 to Warren and 7,438,188 to Slolworthy.

Apertures along a flat surface of a sluice are used in several gold sluice devices, including Ross, supra., U.S. Pat. No. 4,253,943 to Thrasher, which provides a series of apertures with a top plate aperture segment, several series of riffles, an adjustable weir and a Venturi apparatus, and U.S. Pat. No. 4,319,985 to Hibbard, which also employs a screen through which the aggregate slurry flow to a lower tray having a plurality of sluices.

Various textured surfaces on the floor of a sluice device are disclosed in a series of prior art patents, which include U.S. Pat. No. 4,290,527 to Wright, which utilizes a novel type riffle construction including a series of vertical and sloping walls leading to an immediate collection area behind the vertical wall, U.S. Pat. No. 5,785,182 to Ashcraft, involving a bottom panel of a sluice having a plurality of elevated grooves, U.S. Pat. No. 3,970,551 to Wright, which has a plurality of corrugation grooves along a semi-cylindrical trough, with the corrugations being placed angularly along the trough to impart a longitudinal turbulent flow of water and aggregate along the trough and U.S. Pat. No. 4,525,270 to McCann, using a separator with a plurality of grooves, pockets and crevices meant to trap free minerals and gemstones, with the lighter material leaving the sluice.

II. SUMMARY OF THE INVENTION

Gold is often found within aggregate mineral deposits outside active and inactive mines, within streams, river beds and shorelines. In early days, the most common method of finding gold in these areas included the use of gold pans and gold sluices. This early technology has led to several improvements for the separation of gold from the aggregate materials, increasing the amount of aggregate material that can be separated, while trying to optimize the amount of gold extracted from the aggregate and the advance the collected gold containing materials to other finer processing to extract the gold from any further fine aggregate materials. The above indicate prior art shows numerous devices which are used to accomplish this means throughout the years.

The present material separating device, which has been entitled the Gold Cube, is a comparatively small, portable and simple separating system which is developed to provide the separation of a very large quantity of size classified raw aggregate into a small quantity of fine concentrated material, rich particles. The device provides a plurality of interlocking stacked trays having inclined surfaces, with an upper tray providing a flood box to provide a steady even flow of water across a first inclined slick surface, to uniformly wet the aggregate and commence stratification of the wet aggregate to form a slurry. The slurry drops into the first gated axial trough, forcing the wet aggregate underwater and under the gate, further separating the aggregate by specific gravity of the particles and discharging the material in a column by specific gravity, then onto a second inclined surface upon which is placed a vortex mat. A plurality of separation trays may be used to optimize specific mineral separation requirements.

Ultimately, when a desired amount of raw aggregate has been processed, the water is turned off and the vortex mats on the second stacked trays and below are removed and rinsed with water to release the trapped material product. This greatly reduced material aggregate should contain nearly all the heavy metal particles which were contained within the raw aggregate, and would still contain some non-desired particulate materials. However, it is significantly reduced from the original raw aggregate, most commonly converting hundreds of pounds of raw size classified aggregate into approximately a pound of condensed mineral rich concentrates. The Gold Cube accomplishes in a matter of hours a task that would have previously taken weeks with prior art.

III. DESCRIPTION OF THE DRAWINGS

The following drawings are informal drawings submitted with this provisional patent application.

IV. DESCRIPTION OF THE PREFERRED EMBODIMENT

Figure 1:
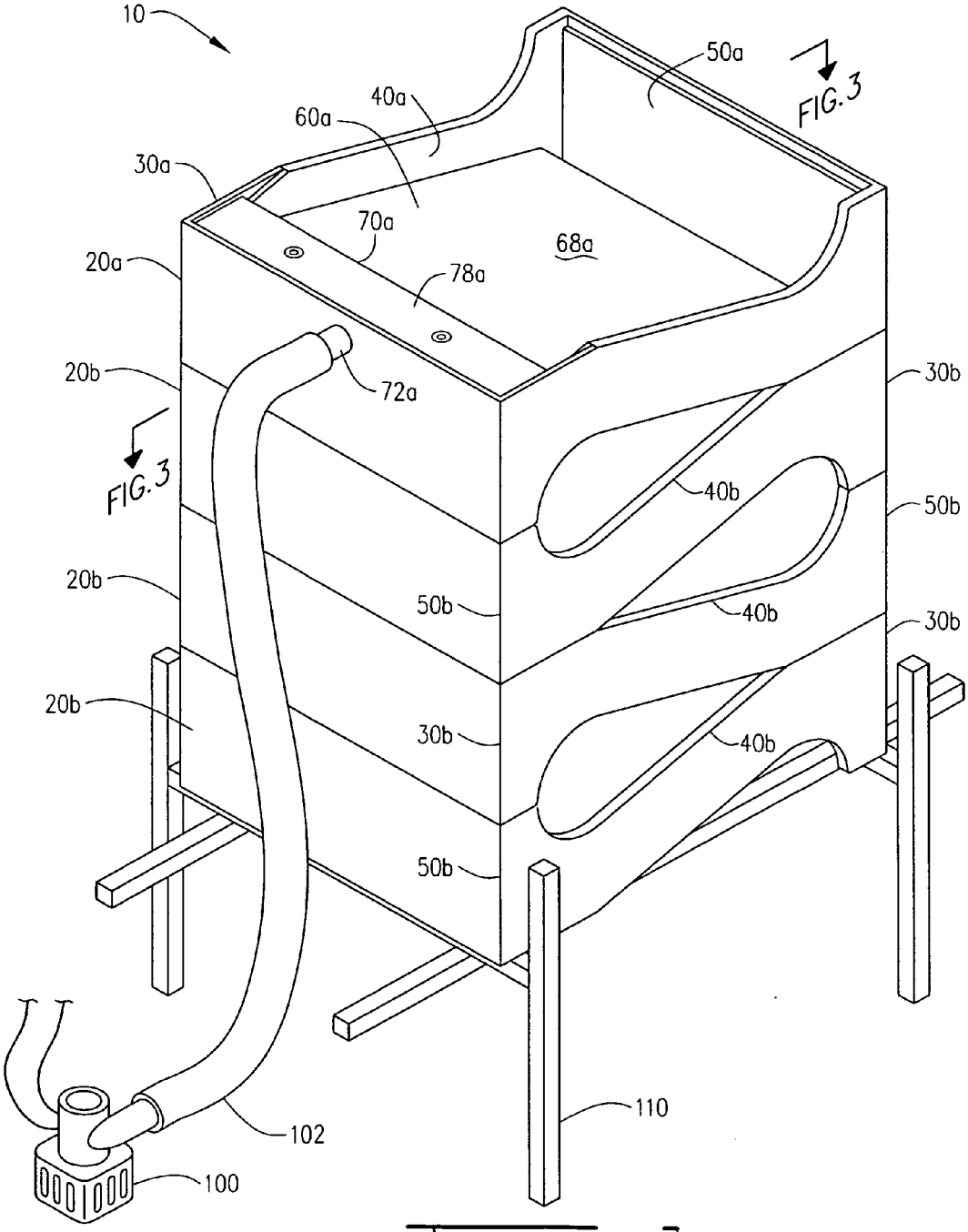
FIG. 1 is a front perspective view of the Gold Cube concentrator device showing an attached water pump and on a collapsible frame component.
Figure 2A:
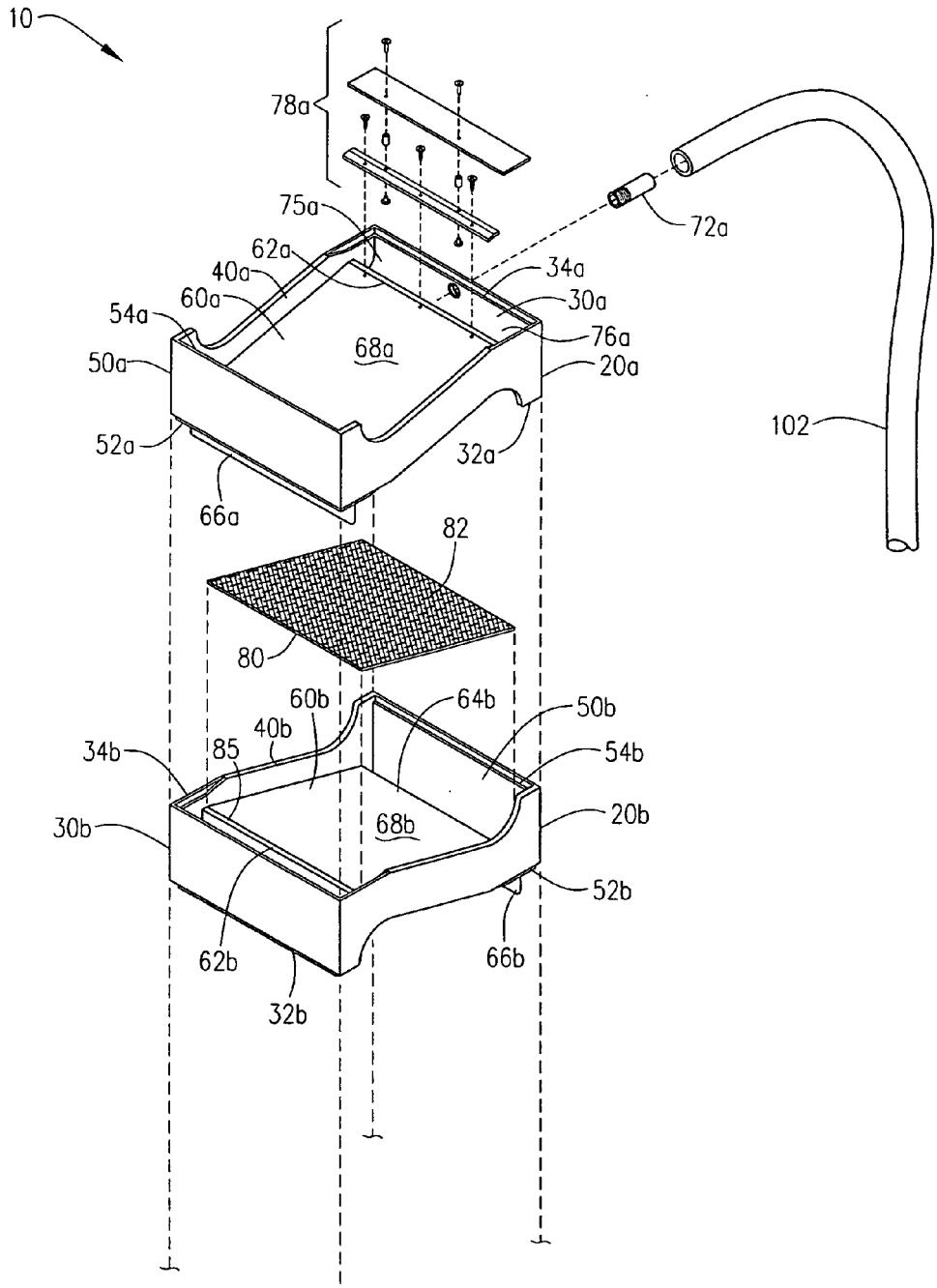
FIG. 2A is an exploded view of a first and second stacked tray of a four tray Gold Cube concentrator device and the hose attachment on the first tray and a vortex mat on the second tray.
Figure 2B:
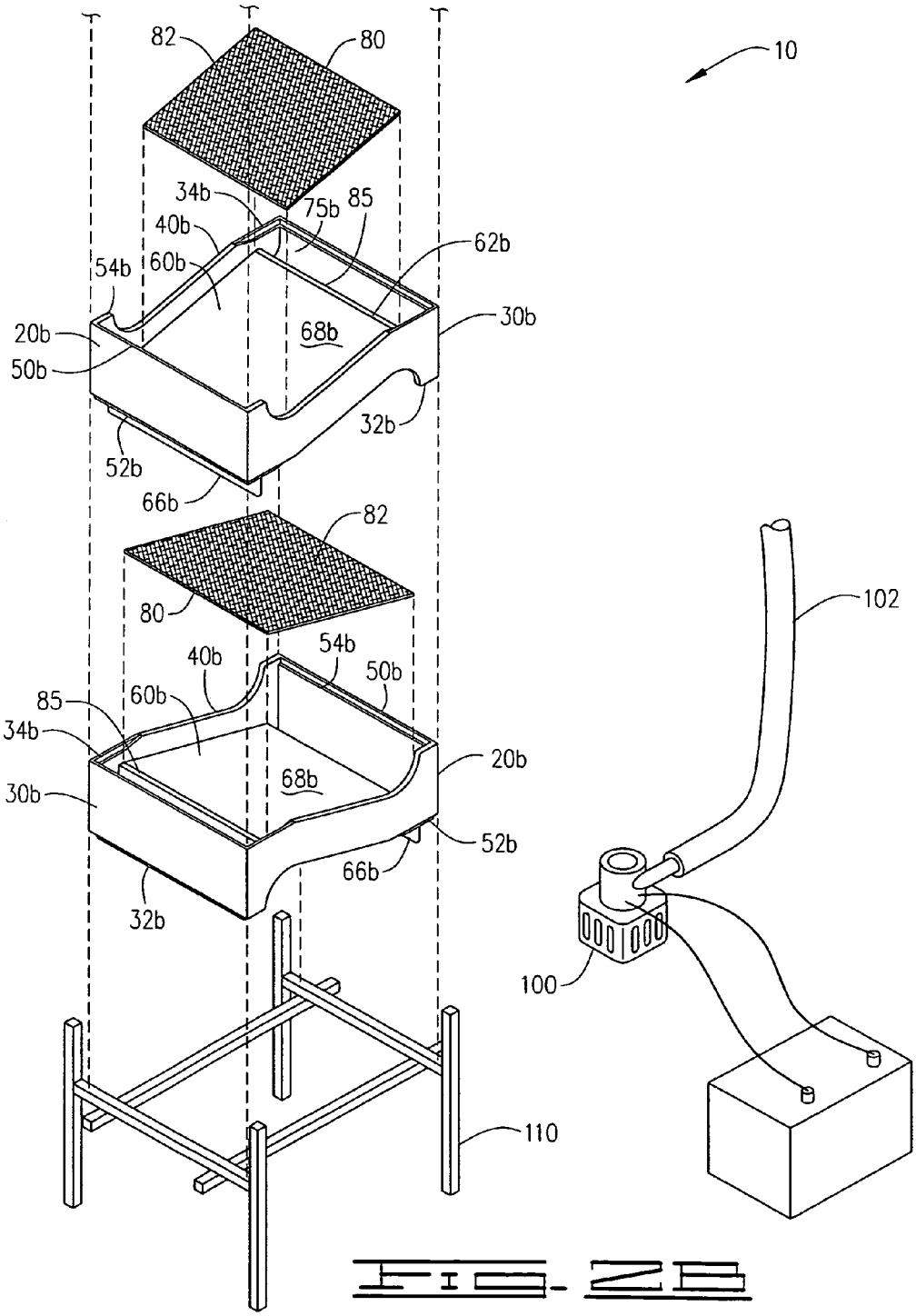
FIG. 2B is an exploded view of a third and fourth stacked tray of the fourth tray Gold Cube concentrator device with a vortex mat on each third and fourth tray, along with the pump and lower hose section.
Figure 3:
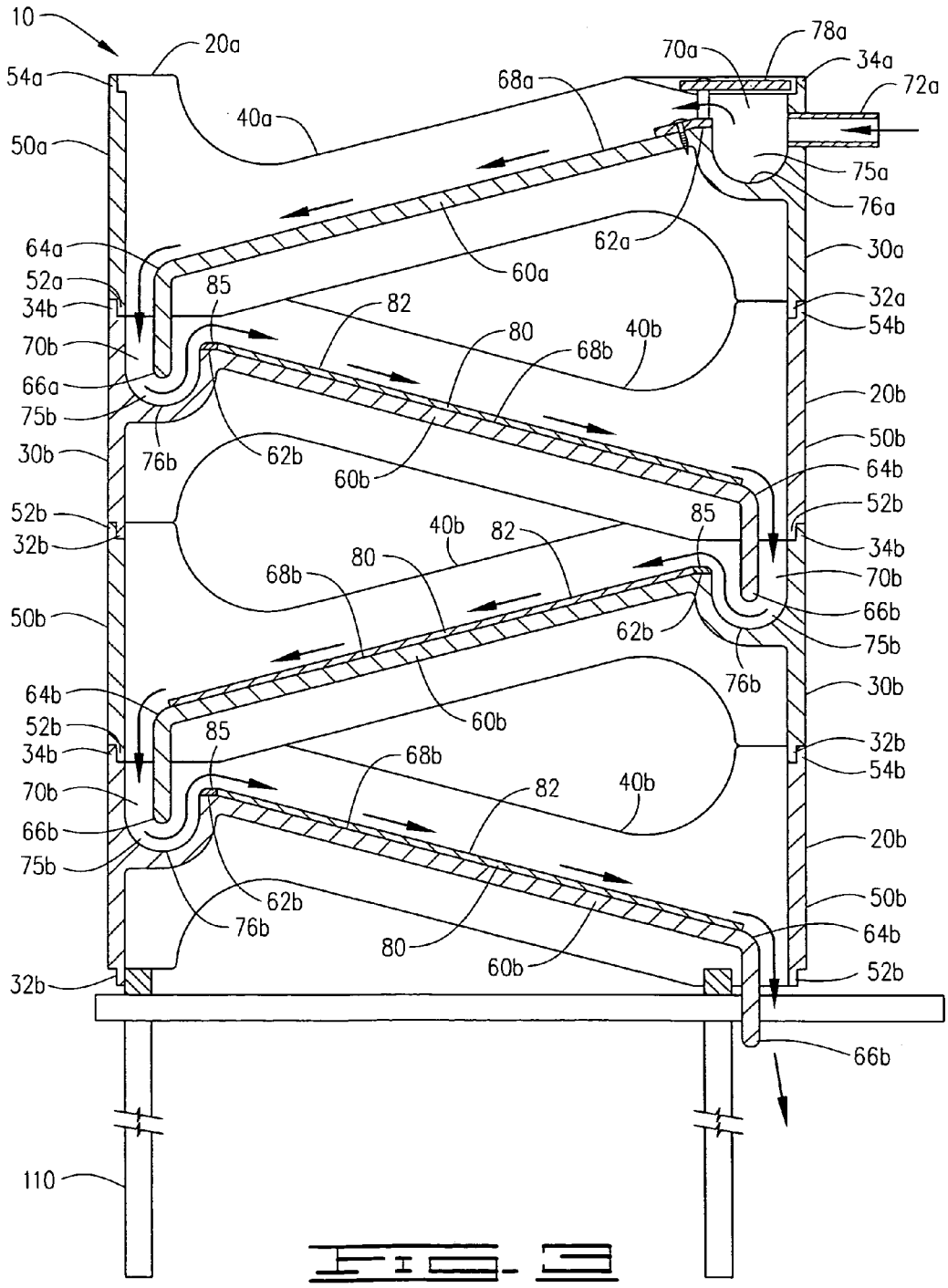
FIG. 3 is a side cross-sectional view of the Gold Cube concentrator device in a four stack embodiment along section lines 3/3 of FIG. 1.

A portable, compact and efficient gold concentrator 10 for the separation of quantities of gold bearing sands and aggregate, shown in FIG. 1-4 of the drawings, provides for three distinct levels separation and reduction of waste materials with the retention of the gold particles in a smaller quantity of aggregate which is sent for further separation by other devices, but in a substantially reduced amount, the gold concentrator 10 comprising a plurality of stacked trays 20*a*, 20*b*, each of the plurality of trays 20*a*, 20*b* defining a first end 30*a*, 30*b*, lateral side portions 40*a*, 40*b* and a second end 50*a*, 50*b*, with a flat inclined section 60*a*, 60*b* between the lateral side portions 30*a*, 30*b* with the flat inclined section 60*a*, 60*b* having an upper edge 62*a*, 62*b* near the first end 30*a*, 30*b* and a lower edge 64*a*, 64*b* near the second end 50*a*, 50*b*, each first end 30*a*, 30*b* defining a first lower connecting means 32*a*, 32*b* and a first upper connection means 34*a*, 34*b* and each second end 50*a*, 50*b* defining a second lower connecting means 52*a*, 52*b* and a second upper connection means 54*a*, 54*b*. Most preferably, each flat inclined section 60*a*, 60*b* provides an angle of 15 degrees from horizontal, plus or minus 5 degrees. Each lower edge 64*a*, 64*b* terminates into a vertical gate 66*a*, 66*b*, which extends downward from the second end 50*a*, 50*b* and below the second end 50*a*, 50*b* and also below the second lower connecting means 52*a*, 52*b*, as indicated in FIGS. 2A-3. In at least one tray, designated as the upper tray 20*a*, FIGS. 1-3, the flat inclined section 60*a* is provided with a smooth flat upper surface 68*a*. The remaining trays, designated as lower trays 20*b*, have a vortex mat 80 upon a similar smooth flat upper surface 68*b*.

In addition, the upper tray 20*a* is also provided with a water inlet 72*a* leading into an axial trough 75*a*, FIGS. 1 and 3, which defines a rounded axial surface 76*a* over which is placed an axial water flow diffuser 78*a*, the axial trough 75*a* receiving a flow of water through the water inlet 72*a* with the diffuser 78*a* removing any turbulence in the water flow and providing a smooth flat current over the upper edge 62*a* and onto the smooth flat upper surface 68*a* of the upper tray 20*a*. This smooth flat upper surface 68*a*, when the water is flowing, is the location whereupon the raw aggregate gold bearing material is initially placed. A secondary optional turbulence filter, not shown, may be placed within the axial water flow diffuser for further smoothing of the water current prior to its flow over the smooth flat upper surface of the upper tray, provided the water is well filtered. This water inlet 72*a* is not present in any lower tray 20*b*.

Figure 4:
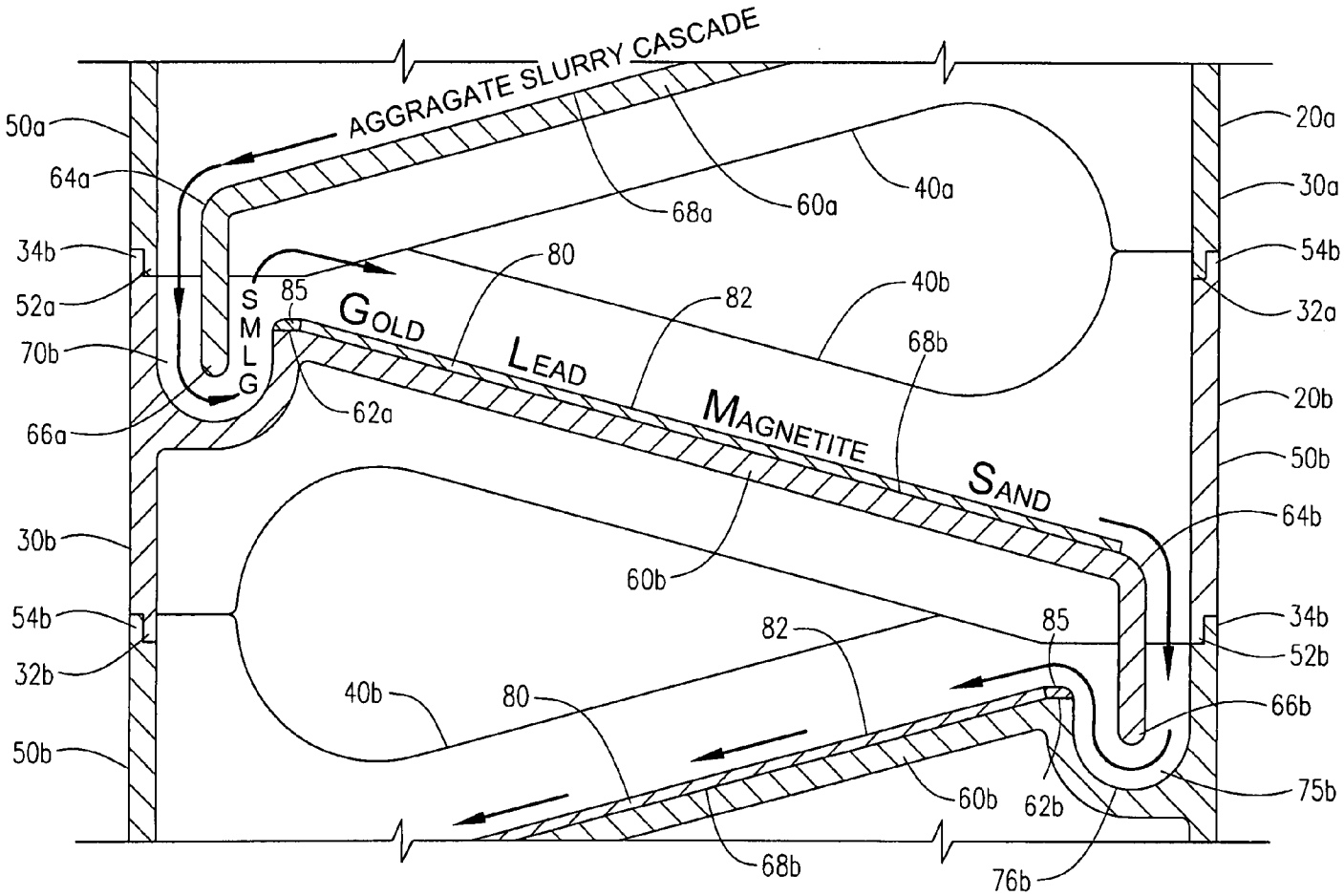
FIG. 4 is a side cross-sectional view of a lower tray with the vortex mat in place demonstrating the separation of a gold bearing aggregate into its individual mineral constituents along the vortex mat, distribution by decreasing specific gravity down the inclined vortex mat.

The lower trays 20*b* are further provided with an axial trough 75*b*, which when connected to a tray above, forms a G force separator 70*b*, FIGS. 3 and 4, the G force separator 70*b* involving each axial trough 75*b* at the first end 30*b* and the vertical gate 66*a*, 66*b* from second end 50*a*, 50*b* of the immediate above tray 20*a*, 20*b*. The function of this G force separator 75*b* will be further defined below. Each lower tray 20*b* having the vortex mat 80 on the smooth flat upper surface 68*b*, provides the vortex mat as a fixed component, although contemplated as a removable vortex mat, with each smooth upper surface 68*b* preferably having an upper elevated axial mat stop 85 to bridge any gap which could otherwise be presented between the flat inclined surface 60*b* and a textured upper surface 82 of the vortex mat 80.

Most simply illustrated, the gold cube concentrator 10 has five primary components—a flood box 70*a*, which is defined within the upper tray 20*a* to include the water inlet 72*a* and the axial trough 75*a*, the smooth flat upper surface 68*a* of the flat inclined section 60*a* of the upper tray 20*a*, the G force separators 70*b*, the vortex mats 80 on the lower trays 20*b*, and flowing water. These components define the three various degrees of separation of the particles. The flood box 70*a* introduces water to the concentrator 10 in an even, non-turbulent form which mixes with all the deposited raw aggregate material fed onto the smooth flat upper surface 68*a* to become wet and not be bound to or trapped within any air bubbles, forming a flowable aggregate slurry. The smooth flat upper surface 68*a* is the sole feed point for the concentrator 10 and is where the size classified aggregate material is deposited by hand or by automated feeder. The aggregate material hits the smooth flowing sheet of water starting the first level of separation and stratification. Light materials are taken quickly by the water to the G force separator 70*b* and the heavier materials flow down the smooth flat upper surface 68*a* until carried into the G force separator 70*b*. More detail as to the composition of the aggregate and the effectiveness of the remaining separation processes are further disclosed below.

The G force separator 70*b* then forces all the deposited aggregate material underwater, stratifies and accelerates the materials, as indicated in FIG. 4, and discharges the materials upward forming a vertical column, with the mineral constituents of the aggregate being separated and elevated in an inverse proportion to each constituent's specific gravity. This G force separator 70*b* provides the second degree of separation of the aggregate materials. Heavy minerals like gold have an affinity to oils found on the surface tension of water. Forcing the heavy material under water reduces the chance of it being washed away. A hydraulic effect is created within the G force separator 70*b*, which creates significantly more pressure to lift the water and material higher than if the water and aggregate simply flowed directly upon the next lower tray. This accelerated flow of water further wets and separates the mixed aggregate traveling around the vertical gate 66*a*, 66*b* and along the rounded axial surface 76*b* of each axial trough 75*b* to aid in the separation of the mixed aggregate slurry.

The aggregate material is comprised of several different mineral constituents of varied particle sizes. The mixed aggregate is a typical black sand found in placer areas where gold is commonly found by prospectors. This aggregate can contain many minerals such as gold, lead, magnetite, and sands, along with other waste materials, as illustrated in FIG. 4. Each of these minerals has a specific gravity based upon a scale wherein water has a specific gravity of zero. Gold is the heaviest of the minerals found in this aggregate black sand mixture. When this aggregate is placed upon the inclined flat surface 60*a* of the first tray 20*a* when the water is running across the smooth flat upper surface 68*a*, the aggregate becomes saturated with water and thinned into the slurry. As it leaves the first tray 20*a* and drops into the first G force separator 70*b*, the water current around the vertical gate 66*a*, 66*b* further separates the aggregate slurry and creates the vertical column, FIG. 4, which allows the lighter material to advance ahead of the heavier materials such as gold as the water and aggregate mixture rises over the upper edge 62*b* of the first end 30*b* of the second tray 20*b* which is attached below the first tray 20*a*. As the column collapses, the lowest specific gravity material will be on the top of the column and the swiftest moving water and will be washed away. Gold and heavy minerals with higher specific gravity will be in the slowest water flow and will be trapped within the textured upper surface 82 in the vortex mat 80 which is placed atop the smooth flat surface 68*b* of the second tray 20*b*, FIG. 4.

The vortex mat 80, in order to trap the minerals according to their specific gravity, with the heavy minerals trapped in descending order from the first end to the second end, would provide the textured upper surface 82 with a plurality of depressions and extensions over the entire textured upper surface 82 of the vortex mat 80. The vortex mat 80 defines the third degree of separation mentioned above, with such vortex mat 80, of some nature and extent being known in the art of gold concentrators, although not used in conjunction with the G force separator 70*b* or anything similar. Similar type mats have been disclosed as "gold collection medium", Loewen, supra., as a "mineral separation bed", Stolworthy, supra., as a flexible riffle mat", Powers, supra, as "coco mat layers" in Ross, supra, as "corrugations" which are angularly oriented with respect to the longitudinal axis of the semi-cylindrical trough configuration" in Wright, supra, and simply as "matting" in Lord, supra. Suffice for the present concentrator 10, the vortex mat 80 would be of similar function but would most preferably be a flexible mat material which securely sets on top of the smooth flat upper surfaces 68*b* of the flat inclined sections 60*b* of the lower trays 20*b* and be designed for the maximum retention of heavy minerals such as gold, yet able to flush out lighter unwanted material until the water flow is removed and the textured upper surface 82 of the vortex mat 80 is rinsed with water to release the trapped particles from the vortex mat 80, as previously indicated. The specific type of fabric most suitable for the vortex mat 80 has been identified as the type of fabric used in inclined conveyor belts which define a cris-cross pattern with a texture comprising a large number of projecting bristles used to supply enhanced friction, this type of belt being cut into sections and secured to the smooth upper surfaces 68*b* of the inclined lower trays by friction, or more likely, an adhesive or staple.

It is demonstrated in testing that the individual minerals are collected along the textured upper surface of the vortex mat 80 in a manner inverse to their specific gravities, with gold being captured mostly at the first end 30*b* upon the vortex mat 80 and the less heavy components captured or discarded further down the vortex mat 80 near the second end 50*a*. The waste materials are seldom captured and are washed out the second end 50*b* of the last tray in the stack.

The water flow of the disclosed concentrator 10, with each tray similar in size to a paint roller tray, stacked in the manner shown in FIGS. 1-4, (alternating flat inclined sections) is preferably at a minimum flow rate of 66 gallons of water per hour times the width of one vortex mat in inches. Thus, using a vortex mat of a 12 inch width, one could process an amount of aggregate material appropriate for a minimal flow rate of 800 gallons of water per hour up to a maximum of 1800 gallons per hour.

The plurality of stacked trays 20*a*, 20*b* is provided due to the different sizes and shapes of the desired gold or precious metal particles. It is noted that the shape of the gold particles can vary a great deal depending upon the location where the gold bearing aggregates may be located. For example, in flowing streams of the western United States, the gold particles tend to be somewhat rounded in shape which affects their movement in the flowing water of the present separating device. In contrast, the gold particles found in the northern United States tend to be flattened flakes which provide a differing hydrodynamic movement in the flowing water of the device than do the rounded particles. In conducting separation of aggregates in these regions, the third and fourth trays of the stacked plurality of trays tend to yield more gold where the gold is flat or flaky as opposed to the third and fourth tray yields where the particles are more rounded. Therefore, the number of stacked trays containing the vortex matting would be preferably increased as required by the size and shapes of the gold being collected.

Although not part of the gold cube concentrator 10, the water source may be delivered from a contained water supply or from the lake, river or stream nearby. The water may be recycled after passing through the gold cube concentrator 10, or disposed of in an ecologically feasible manner. The water may be filtered prior to reuse, if recycling is a chosen option. The water supply used in the system should be filtered in some manner, to prevent the gold cube concentrator 10 from being exposed to oily residues, dirt, chemical contaminants or water borne biological materials, all of which can reduce the effectiveness of the performance of the gold cube concentrator 10. Thus, at a minimum, the water introduced into the gold cube concentrator 10 should be as free from any contaminants and use pure water, if such pure water is available. A recycling pump 100, shown in FIGS. 1 and 2B, are connected to the water inlet by a hose 102, which provides the source for the water flow in the concentrator 10. A simple elevated stand 110 is also shown in FIGS. 1, 2B and 3 to elevate, support and provide the concentrator 10 in a level plane to ensure proper operation of the concentrator 10 and its various functional features provided by the defined and claimed features presented.

Although the embodiments of the Gold Cube concentrator 10 have been described and shown above, it will be appreciated by those skilled in the art that numerous modifications may be made therein without departing from the scope of the invention as herein described. It is contemplated within the scope of the gold concentrator 10 that various disclosed features may be altered, amended or exchanged throughout the course of time. For example, a water basin, not shown, may be placed underneath the concentrator 10 to collect expelled water and then recycled for continued use with a filter being placed where the water is expelled from the concentrator 10 prior to being caught in the basin to provide a filtered water supply prior to reuse. It is contemplated that the plurality of stacked trays may be provided in a linear embodiment, or it could be modified to allow for a linear connection of the four trays with each flat inclined surface 60*a*, 60*b* declining at the same angle and direction, directing the water and aggregate slurry in the same direction and forming a straight slope sluice device with one or more G force separators 70*b* being included in the linear embodiment. It is anticipated that this configuration would have a much less effectiveness in actually separating gold particles from the aggregate and make the concentrator 10 virtually useless.

In testing of the preferred concentrator, the one upper tray 20*a* and three lower trays 20*b* have shown the most effective gold retention where the gold particles are more flat and flaky, but one upper tray 20*a* with two lower trays 20*b* have shown to be effective where the gold is more rounded and smooth. Thus, at a bare minimum, one upper tray 20*a* and one lower tray 20*b* will retrieve a large amount of gold particles in the aggregate slurry, but the addition of a second or third lower trays 20*b* has shown to enhance the recovery of some of the smaller particles of gold.

The most preferable and best mode of operation and disclosure is shown in FIGS. 1 and 3, which is preferable for the sake of a compact orientation as well as operation, having the first lower connecting means 32*a* of the upper tray 20*a* attached to the second upper connecting means 54*b* of the next lower tray 20*b* and the second lower connecting means 32*a* of the upper tray 20*a* attached to the first upper connecting means 34*b* of the same next lower tray 20*b*, and so forth, with a stack of multiple trays, reversing the flow of water and resulting in a greater column being formed in the G force separator, further resulting in an enhanced second degree of separation and improved third degree of separation. It is further contemplated that an additional separation for larger particles may be shown which would propose modification of the axial trough 75*b* to include indentations, pockets, squared impressions in the axial trough or other alterations to the otherwise smooth axial trough, with the intent to provide an additional trapping of heavy gold particles in the ebbs or pockets created in the otherwise flowing water through the axial trough. it is anticipated that while this might yield some additional containment of larger gold particles, it could also provide a negative effect upon the formation of the column and separation of the aggregate during the second degree of separation, and actually be detrimental to the function of the concentrator 10.

We claim:

1. A portable and compact gold concentrator for separation of quantities of gold bearing sands and aggregate, providing three distinct process levels of separation and reduction of waste materials with retention of gold particles, said gold concentrator comprising:

a first stacked tray defining a smooth flat inclined surface contained within a first end, second end and two lateral side portions having a first end defining a flood box with a water inlet wherein a smooth and controlled flow of water is introduced upon said smooth flat inclined surface, said smooth flat inclined surface locating an area for the deposit of gold bearing aggregate within said flow of water forming an aggregate slurry;

a second stacked tray defining a smooth flat inclined surface upon which is secured a vortex mat defining a textured upper surface, said flat inclined surface contained within a first end, second end and two lateral side portions, said first end further providing a G force separator defining an axial trough with said first end having a smooth and rounded axial surface and incorporating a vertical gate descending from said second end of said first stacked tray within said axial trough, wherein said aggregate slurry is separated by three physical processes into various minerals to collect any gold content within said aggregate slurry, first by said placement upon said smooth flat inclined surface of said first stacked tray into said flow of water to form said aggregate slurry, second by the formation of a column by the aggregate slurry as it is accelerated through said G force separator to form a vertical aggregate slurry column with each said component of said aggregate slurry separated by a respective specific gravity, and third, by the collapse of the column subsequent to the G force separator upon the vortex mat, with said gold particles trapped within said vortex mat and said remaining aggregates slurry discharged from said second end of said second stacked tray as waste.

2. The gold concentrator, as disclosed in claim 1, wherein said flat inclined section of each said first stacked tray and said second stacked tray is 15 degrees±5 degrees from horizontal within said concentrator.

3. The gold concentrator as disclosed in claim 1, wherein said vortex mat is affixed to said smooth flat inclined surface of said second stacked tray in a permanent manner against a mat stop at said upper end to remove any gap or elevation between said upper end and said vortex mat.

4. The gold concentrator as disclosed in claim 1, wherein said vortex mat removably placed upon said smooth flat inclined surface against a mat stop at said upper end to remove any gap or elevation between said upper end and said vortex mat during use.

5. The gold concentrator as disclosed in claim 1, wherein each said first stacked tray and said second stacked tray are produced as identical integrated components from an injected molded plastic material, with said first stacked tray having said water inlet and said axial water flow diffuser added to said first stacked tray and said second stacked tray having said vortex mat added to said smooth flat inclined surface, said first stacked tray and each said at least one second stacked tray stacked upon another to form said concentrator.

6. The gold concentrator as disclosed in claim 1, wherein said water supply is introduced into said flood box by a recycling pump attached to said water inlet by a hose.

7. The gold concentrator as disclosed in claim 1, wherein said water supply is provided by a hose attached between said water inlet and a recycling pump within a water source, said water source collecting and filtering said waste discharged from said remaining aggregate slurry deposited from said second end of said second stacked tray.

8. The gold concentrator as disclosed in claim 1, wherein said gold concentrator is formed from said first stacked tray and two said second stacked trays, with each stacked first and second stacked trays attached to provide each next subsequently stacked respective flat inclined surface being inclined at opposite angles of 15 degrees±5 degrees from horizontal from one another within said concentrator.

9. The gold concentrator as disclosed in claim 1, wherein said gold concentrator is formed from said first stacked tray and three said second stacked trays, with each stacked first and second stacked tray attached to provide each next subsequently stacked tray having respective smooth flat inclined surface being inclined at opposite angles of 15 degrees±5 degrees from horizontal from one another within said concentrator.

10. The gold concentrator as disclosed in claim 1, further comprising an adjustable support stand upon which said gold concentrator is placed to provide a level means of support for said gold concentrator during use, maintaining each respective smooth flat inclined surfaces at opposite inclined angles of 15 degrees±5 degrees from horizontal from one another within said concentrator.

11. A portable and compact gold concentrator for separation of quantities of gold bearing sands and aggregate, providing three distinct process levels of separation and reduction of waste materials with retention of gold particles, said gold concentrator comprising:

a first stacked tray defining a first end, two lateral side portions, a second end, and a flat inclined section with a smooth upper surface between said lateral side portions, said flat inclined section providing an upper edge near said first end and a lower edge said second end terminating into a vertical gate extending downward and below said second end, each first end further defining a first lower connecting means and a first upper connection means and each second end defining a second lower connecting means and a second upper connection means, said first end further defining a flood box including a water inlet for receiving a water supply, an axial trough with a rounded axial surface and an axial water flow diffuser;

at least one second stacked tray attaching below said first stacked tray, said second stacked tray defining a first end, two lateral side portions, a second end, and a flat inclined section with a smooth upper surface between said lateral side portions, said flat inclined section providing an upper edge near said first end and a lower edge said second end terminating into a vertical gate extending downward and below said second end, each first end further defining a first lower connecting means and a first upper connection means and each second end defining a second lower connecting means and a second upper connection means, said first end further forming a G force separator which is defined by said vertical gate from said second end of said stacked tray attaching above said at least one second stacked tray, an axial trough having a smooth rounded axial surface defined within said at least one second stacked tray at said first end, said smooth upper surface of said at least one second stacked tray is covered by a vortex mat having an upward oriented textured upper surface, wherein a smooth flowing water supply is introduced into said concentrator from said flood box, forming a flowing aggregate slurry with a quantity of gold bearing aggregate deposited upon said smooth upper surface of said first stacked tray as a first degree of separation to said aggregate slurry, said aggregate slurry forced through said G force separator to form a column with the aggregate constituents being lifted within said column in accordance with a diverse specific gravity of each aggregate constituent of said aggregate slurry with gold being the heaviest and lowest within said column, said G force separator providing a second degree of separation, with a third degree of separation occurring as said column collapses and is propelled upon said textured upper surface of said vortex mat, wherein heavier gold particles within said aggregate slurry are retained within said textured upper surface while lighter aggregate components of said aggregate slurry are washed out said second end of said lower stacked tray and deposited as waste.

12. The gold concentrator, as disclosed in claim 11, wherein said flat inclined section of each said first stacked tray and each said at least one second stacked tray is 15 degrees±5 degrees from horizontal within said concentrator.

13. The gold concentrator as disclosed in claim 11, wherein said vortex mat is affixed to said smooth upper surface in a permanent manner and said smooth upper surface further defines a mat stop at said upper end along said upper edge against which said vortex mat is positioned to remove any gap or elevation between said upper edge and said vortex mat.

14. The gold concentrator as disclosed in claim 11, wherein said vortex mat removably placed upon said smooth upper surface and said smooth upper surface further defines a mat stop at said upper end along said upper edge against which said vortex mat is positioned to remove any gap or elevation between said upper edge and said vortex mat during use.

15. The gold concentrator as disclosed in claim 11, wherein each said first stacked tray and each said at least one second stacked tray or produced as identical integrated components from an injected molded plastic material, with said first stacked tray having said water inlet and said axial water flow diffuser added to said first stacked tray and each said at least one second stacked tray having said vortex mat added to its respective smooth upper surface, said first stacked tray and each said at least one second stacked tray stacked upon another to form said concentrator.

16. The gold concentrator as disclosed in claim 11, wherein said water supply is introduced into said flood box by a recycling pump attached to said water inlet by a hose.

17. The gold concentrator as disclosed in claim 1, wherein said water supply is provided by a hose attached between said water inlet and a recycling pump within a water source, said water source collecting and filtering said waste discharged from said remaining aggregate slurry deposited from said second end of said at least one second stacked tray.

18. The gold concentrator as disclosed in claim 11, wherein said gold concentrator is formed from said first stacked tray and two of said at least one second stacked trays, with each stacked first and second stacked tray attached to provide each respective flat inclined surface being inclined at opposite angles of 15 degrees±5 degrees from horizontal within said concentrator.

19. The gold concentrator as disclosed in claim 11, wherein said gold concentrator is formed from said first stacked tray and three of said at least one second stacked trays, with each stacked first and second stacked tray attached to provide each respective flat inclined surface being inclined at opposite angles of 15 degrees±5 degrees from horizontal within said concentrator.

20. The gold concentrator as disclosed in claim 11, further comprising an adjustable support stand upon which said gold concentrator is placed to provide a level means of support for said gold concentrator during use, maintaining each respective smooth flat inclined surfaces at opposite inclined angles of 15 degrees±5 degrees from horizontal from one another within said concentrator.

* * * * *